US005795052A

United States Patent [19]

Choi

[11] Patent Number: 5,795,052

[45] Date of Patent: Aug. 18, 1998

[54] LAMP DRIVING CONTROL APPARATUS AND METHOD FOR A WASHING MACHINE

[75] Inventor: Ssi Chol Choi, Suwon, Rep. of Korea

[73] Assignee: Samsung Electronics Co., Ltd., Suwon, Rep. of Korea

[21] Appl. No.: 746,337

[22] Filed: Nov. 8, 1996

[30] Foreign Application Priority Data

Nov. 9, 1995 [KR] Rep. of Korea ..... 1995-40471

[51] Int. Cl.[6] ..... D06F 39/00

[52] U.S. Cl. ..... 362/91; 362/155; 362/276; 362/802

[58] Field of Search ..... 362/91, 154, 155, 362/276, 802

[56] References Cited

U.S. PATENT DOCUMENTS

| | | | |
|---|---|---|---|
| 2,656,451 | 10/1953 | Rick | 362/91 |
| 2,737,573 | 3/1956 | Olthuis | 362/91 |
| 3,619,592 | 11/1971 | Lamb, Jr. | 362/91 |

*Primary Examiner*—Stephen F. Husar
*Attorney, Agent, or Firm*—Burns, Doane, Swecker & Mathis, L.L.P.

[57] ABSTRACT

Disclosed is a lamp driving control apparatus for a washing machine and a control method therefor which control operation of a lamp in accordance with a door opening/closing operation in the washing machine. A lamp driving control apparatus resides within washing machine which washing machine includes a main body, a door mounted to the main body, a door motor for providing power to open and closed the door, and a lamp that is turned on when the door is opened in order to illuminate an interior of the main body. The control apparatus includes: a door open sensor for sensing whether the door is opened by a predetermined angle corresponding to a fully opened door; and a controller for turning on the lamp when the door is opened beyond the predetermined angle corresponding to the fully opened door. A lamp driving control method for the washing machine includes the steps of: determining whether the door is opened beyond a predetermined angle corresponding to a fully opened door; turning on the lamp for a predetermined time when the door is fully opened, or turning off the lamp when the door is not fully opened; and turning off the lamp when a predetermined time has lapsed after turning on the lamp. Accordingly, power consumption waste caused by the lamp being driven when the door is not fully opened is avoided.

8 Claims, 8 Drawing Sheets

| | DOOR CLOSING SWITCH (61) | DOOR OPENING SWITCH (51) |
|---|---|---|
| 1 AREA | ON | OFF |
| 2 AREA | OFF | OFF |
| 3 AREA | OFF | ON |

LAMP DRIVING CONTROL APPARATUS AND METHOD FOR A WASHING MACHINE

BACKGROUND OF THE INVENTION (1) Field of the Invention

The present invention relates to a lamp driving control apparatus for a washing machine and a control method therefor which control operation of a lamp according to a door opening/closing operation in a washing machine. More particularly, it relates to a lamp driving control apparatus for a washing machine and a control method therefor which determine a door open or closed state by using a door open sensor and a door closed sensor, and turn on a lamp for a predetermined time under only in door fully opened state wherein the door is opened beyond a predetermined angle.

(2) Description of the Prior Art

Generally, a washing machine uses a motor for power, and initiates a water movement by driving a pulsator and an agitator, so that the water movement provides desirable laundry agitation. Accordingly, the washing machine can wash the laundry.

FIG. 1 shows a perspective view of a conventional washing machine that includes a lamp.

As shown in FIG. 1, the conventional washing machine includes: a main body 1; a cylindrically-shaped water tub (not shown) mounted in the inside of the main body 1; a washing tub 2 which is rotatably mounted in the water tub and has a plurality of holes 3 for allowing water to be in continual communication with the water tub; a pulsator 4 which is rotatably mounted in a lower part of the washing tub 2; a driver (not shown) which is mounted in a lower part of the water tub and which drives the water tub and the pulsator 4; and a door 7 which is mounted in an upper part of the main body 1.

A fully automatic washing machine additionally includes a controller wherein a procedure for washing, rinsing, drain and spinning is previously programmed along with the above driver. Therefore, a user can select either an automatic washing procedure which performs a complete washing cycle (i.e., washing→>rinsing→>drain→>spinning) or a partial washing procedure which performs a partial washing cycle. As a result, the laundry is automatically washed according to the user'selection.

The washing machine includes illumination lamps 8 to illuminate the inside of the washing tub 2 when the user uses the washing machine in the dark. The illumination lamp 8 is turned on when the door is opened. The illumination lamp 8 is turned on by a microprocessor when a door open state is sensed by a door open sensor 5. The illumination lamp 8 is turned on simultaneously with the door opening, and is automatically turned off after a predetermined time.

In the washing machine, the door open sensor 5 includes a magnet **5*a* mounted to one side of the door 7, and a reed switch 5*b* whose contact is switched by a magnetic force of the magnet 5*a***.

However, in a conventional washing machine with an illumination lamp, although a user opens the door 7 by a predetermined angle, the magnet **5*a* is separated from the reed switch 5*b* by a constant distance, thereby operating the reed switch 5*b*. Simultaneously, a controller determines an open state of the door 7**, and thus turns on the illumination lamp.

However, such a conventional washing machine causes a motor to be driven under even in an incomplete door opening state, and also causes the illumination lamp 8 to be turned on. This operation may provide a momentary overload to a power-supply, and thus may causes a damage to the machine. The illumination of the lamp 8 causes unnecessary power consumption while driving a door motor.

Furthermore, the user'carelessness may leave the door ajar. To solve these problems, it is necessary to check whether the door is open or closed, and to sequentially induce a door motor operation and an illumination lamp operation to be considered to prevent a bad influence on an interaction therebetween.

SUMMARY OF THE INVENTION

The present invention is directed to a lamp driving control apparatus for a washing machine and a control method therefor that substantially obviate one or more of the problems due to limitations and disadvantages of the related art.

An object of the present invention is to provide a lamp driving control apparatus for a washing machine and a control method therefor which sequentially control turning on and turning off an illumination lamp.

Another object of the present invention is to provide a lamp driving control apparatus for a washing machine and a control method therefor which turn on a lamp for a predetermined time only when the door is fully opened.

Additional features and advantages of the invention will be set forth in the description which follows, and in part will be apparent from the description, or may be learned by practice of the invention. The objectives and other advantages of the invention will be realized and attached by the structure particularly pointed out in the written description and claims hereof as well as the appended drawings.

SUMMARY

In order to achieve the above objects and others, a lamp driving control apparatus for a washing machine which includes a main body, a door mounted to the main body, a door motor for providing a force to open and close the door, and a lamp that is turned on when the door is opened in order to illuminate the inside of the main body, the control apparatus includes:

a door open sensor for sensing whether the door is open by a predetermined angle corresponding to a fully opened state; and a controller for turning on the lamp when the door is opened beyond the predetermined angle corresponding to the fully opened state.

A lamp driving control method for a washing machine which includes a main body, a door mounted to the main body, a lamp for illuminating the inside of the main body, a door motor for providing a force to open and close the door, and door open and closed sensors for sensing either a door open or a door closed state, the method includes the steps of:

sensing either a door fully opened state or a door fully closed state for a predetermined time; and turning on the lamp for a predetermined time according to the fully opened state.

More specifically, the lamp driving control method includes the steps of:

determining whether a door open or door close command is input;

determining a current door state according to a sensed result from the door opened and closed sensors;

determining a fully opened state or a fully closed state according to a door opening/closing state; and determining a turn on and a turn off requirement of the lamp according to the fully opened and the fully closed states.

Furthermore, the step of operating the lamp according to the door opening/closing state includes the steps of:

determining whether the door is opened beyond a predetermined angle corresponding to a opened state;

turning on the lamp for a predetermined time when the door is fully opened, or turning of f the lamp when the door is not fully opened; and turning off the lamp when a predetermined time elapses after turning on the lamp.

In addition, the step for determining whether the door is opened beyond the predetermined angle corresponding to the fully opened state includes:

a first step in which the door open sensor is 'ON' by the door motor driving and then senses whether the door is opened; and a second step in which a predetermined time elapses after the door motor stops driving.

It is to be understood that both the foregoing general description and the following detailed description are exemplary and explanatory and are intended to provide further limits of the invention as claimed.

BRIEF DESCRIPTION OF THE DRAWINGS

The preferred embodiment of the present invention will now be described more specifically with reference to the attached drawings, wherein.

DETAILED DESCRIPTION OF THE PREFERRED EMBODIMENT

The preferred embodiment of the present invention will become apparent from a study of the following detailed description, when viewed in light of the accompanying drawings.

Figure 1:
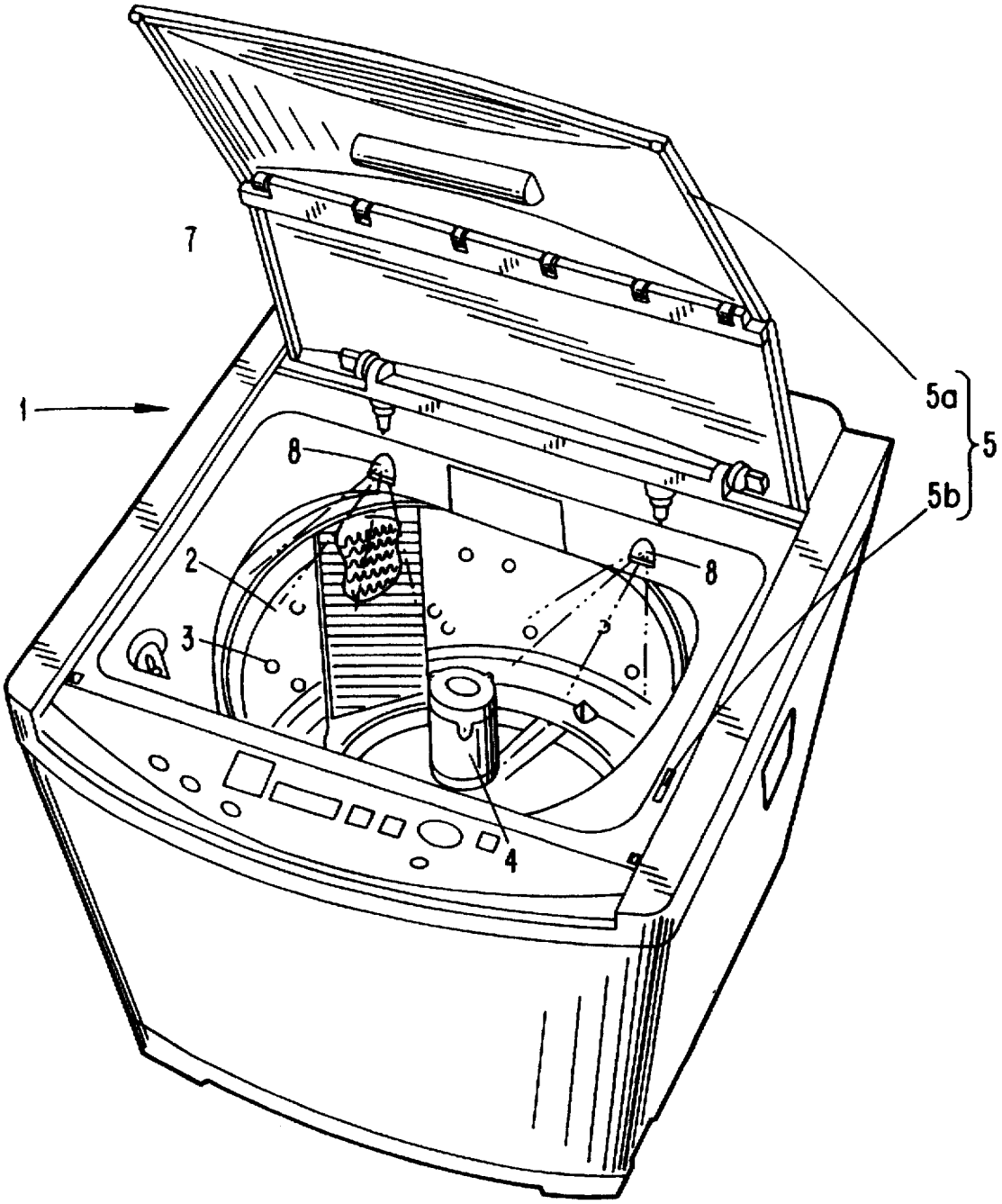
FIG. 1 (PRIOR ART)
FIG. 1 is a perspective view of a conventional washing machine with a lamp.
Figure 2:
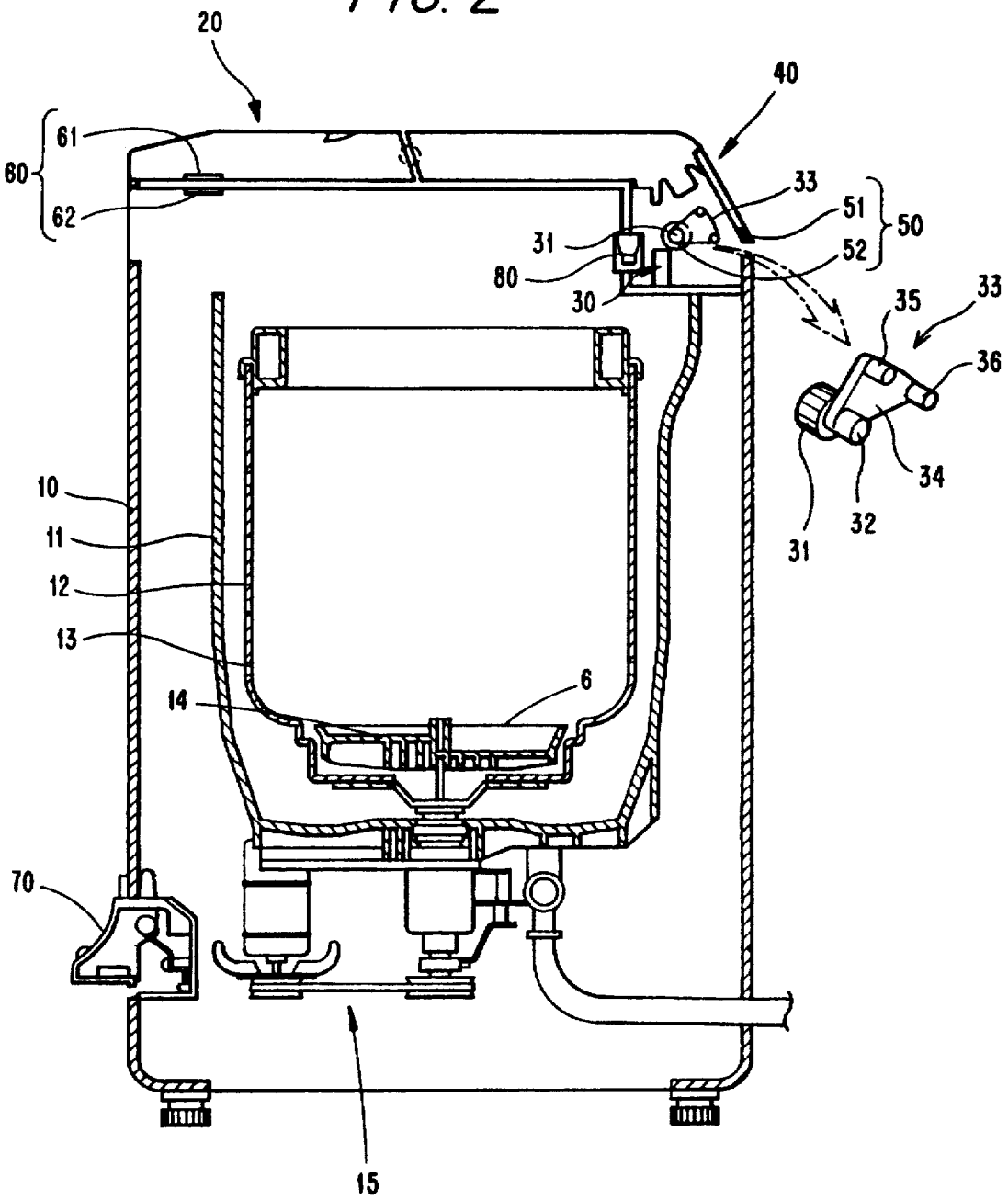
FIG. 2 is a side-sectional view of a washing machine according to the present invention.

FIG. 2 is a side-sectional view of a washing machine according to the present invention.

As shown in FIG. 2, a washing machine according to the present invention includes:

a main body 10 which forms an outer casing; a water tub 11 which is placed inside of the main body 10, and contains water;

a washing tub 12 which is rotatably mounted in the water tub 11 and has a plurality of holes 13 allowing the communication of water to the contents of washing tub 12;

a pulsator 14 which is rotatably (for forward and reverse rotations) mounted to a bottom of the washing tub 12, and generates water movement; and a driver 15 which is mounted to a bottom of the water tub 11, and selectively rotates the washing tub and a pulsator 14.

A door 20 is mounted on the top of the main body 10. An illumination lamp 80 is mounted near a lower part of the door 20 in order to illuminate the washing tub 12.

The washing machine according to the present invention includes: a driving/rotating member 30 which is mounted to the main body 10, and rotates the door 20 in forward and reverse directions; and a cam member 40 which is engaged by the driving/rotating member 30 which rotates. Accordingly, the door 20 can be automatically opened or closed by the user's one-touch operation.

The driving/rotating member 30 includes: a motor 31; a rotating shaft 32 coupled to the motor 31 as one body; and a rotary member 33 which is connected to the rotary shaft 32, and has a rotating center centered on the rotating shaft 32, and rotates.

The motor 31 is preferably embodied as a geared D.C. motor that rotates bidirectionally at a slow speed and with high torque.

The rotary member 33 consists of a rotary plate 34 formed in a wedge shape and having first and second bosses 35 and 36 that protrude normally from corners of the front of the rotary plate 34.

A one-touch button for driving the motor 31 can be positioned on a control panel (not shown) mounted on the top of the main body 10, so the user can easily manipulate the one-touch button. However, as shown in FIG. 2, a one-touch button 70 is embodied as a foot switch arranged at a lower part of the front side of the main body 10, so a user can manipulate the one-touch button 70 with a foot.

A door open sensor 50 and a door closed sensor 60 which are used to stop a driving of the motor 31 in order to stop the door opening operation and the door closing operation, are respectively mounted to a rear part and a front part of the door.

That is, when the door closing operation is terminated, the motor 31 stops driving in response to a signal from the door closed sensor 60. When the door opening operation is terminated, the motor 31 stops driving the door in response to a signal from the open sensor 50.

The door open sensor 50 and the door closed sensor 60 are embodied as reed switches whose contacts are switched by a magnetic force, so that the motor 31 stops driving before the door 20 contacts the main body 10. Accordingly, a noise generated when the door 20 hits against the main body 10 by torque of the motor 31 can be prevented.

Figure 3:
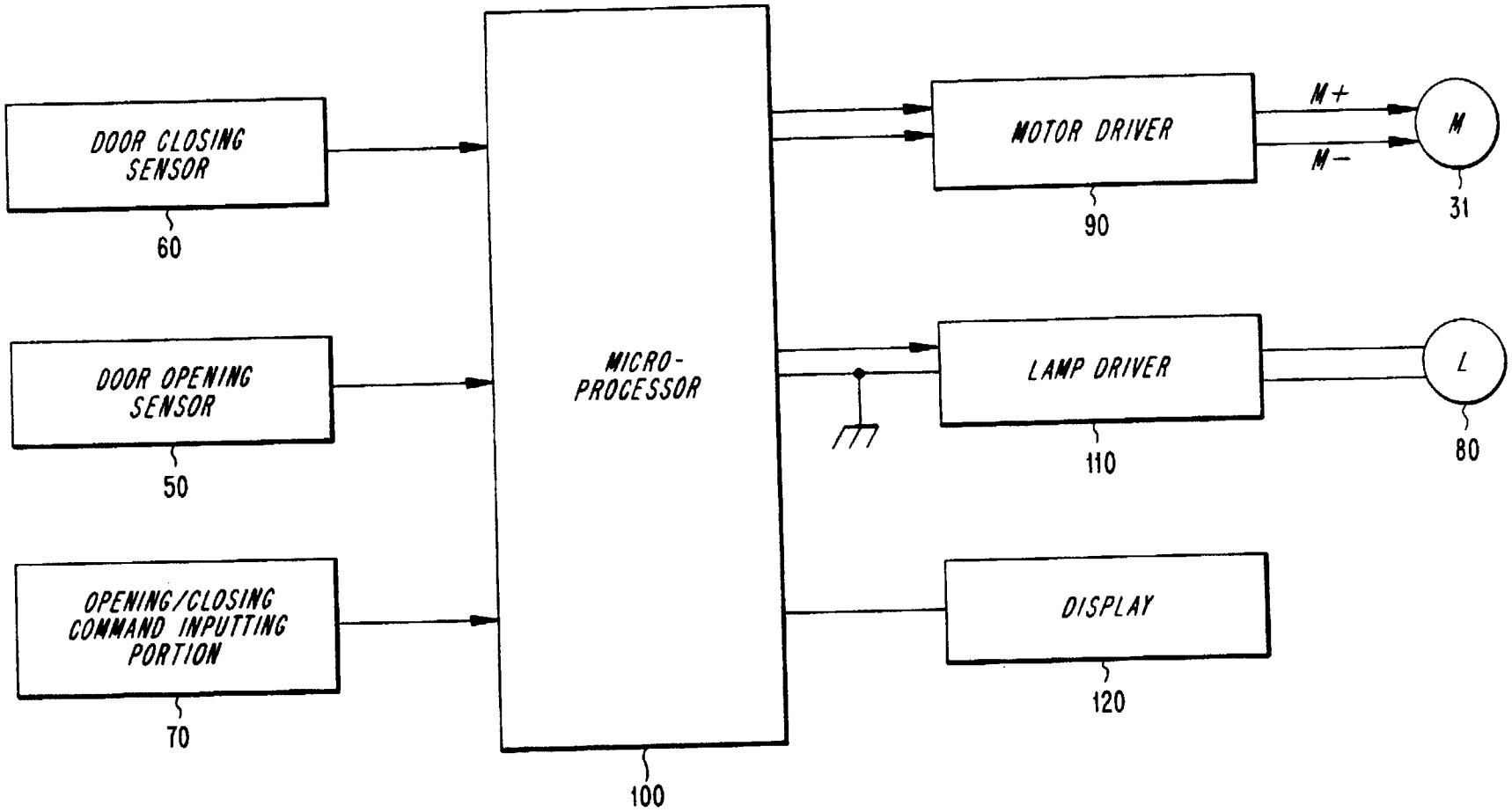
FIG. 3 is a control block diagram of a washing machine according to the present invention.
Figure 4:
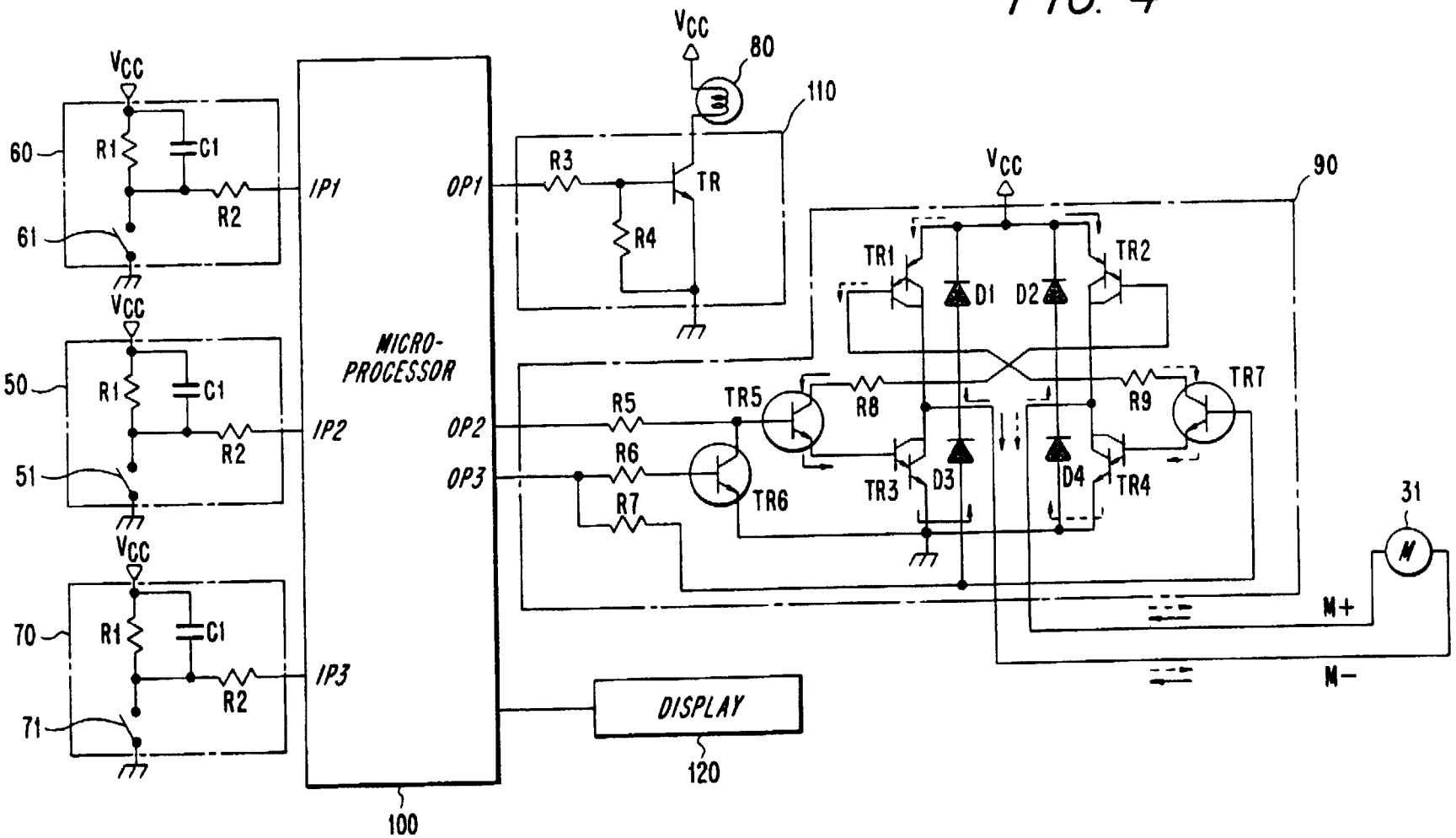
FIG. 4 is a detailed circuit diagram of a washing machine according to the present invention.

FIG. 3 is a control block diagram of a washing machine according to the present invention; and FIG. 4 is a detailed circuit diagram of a washing machine according to the present invention.

As shown in FIGS. 3 and 4, the washing machine according to the present invention includes:

a door open sensor 50 for sensing an opened state of the door 20;

a door closed sensor 60 for sensing a door closed state of the door 20;

opening/closing command input means 70 for receiving a command to open/close the door 20 from the user;

a motor driver 90 which drives a motor 31 to open/close the door 20 according to a command from the door opening/closing command input means 70;

a lamp driver 110 which drives a lamp 80 for illuminating a washing tub 12 and is turned on or off according to signals from the door open sensor 50 and the door closed sensor 60;

a display 120 which displays a function selected by the user and a current driving state; and a microprocessor (hereinafter referred to as a MICOM) 100 which is connected between the door open sensor 50, the door closed sensor 60; and connects the door opening/closing command input portion 70 to the motor driver 90; connects the lamp driver 110 and the display 120; and controls the motor driver 90, the lamp driver 110 and the display 120 according to an operating state of the door open sensor 60 and the door opening/closing command input means 70.

Referring to FIG. 4, the door open sensor 50 and the door closed sensor 60 each have reed switches 51 and 61, respectively, connected to supply voltage Vcc via a resistor R1. Each intermediate tap between the reed switches 51 and 61 and the resistors R1 is coupled with input terminals IP1 and IP2 of the microprocessor 100 via a resistor R2. The door opening and closing sensing portions 50 and 60 have capacitors Cl each coupled in parallel with the resistors R1 and supply voltage Vcc.

The opening/closing command input means 70 includes a foot switch 71 connected to a supply voltage Vcc via a resistor R1. An intermediate tap between the foot switch 71 and the resistor R1 is connected to an input terminal IP3 via a resistor R2. A capacitor C1 is connected to the resistor R1 and the supply voltage Vcc in parallel.

The lamp driver 110 includes:

a transistor TR1 of which a base is connected to an output terminal OP1 of the MICOM 100 via a resistor R3 and an emitter is grounded;

a resistor R4 of which one terminal is connected to the base of the transistor TR, and the other terminal is connected to the emitter of the transistor TR and is then grounded; and a lamp 80 of which one terminal is connected to a collector of the transistor TR and the other terminal is connected to a power-supply.

In the motor driver 90, a forward rotation of the motor 31 means a rotation having a direction of M—>M+, and a reverse rotation of the motor 31 means a rotation having a direction of M+—>M−.

The motor driver 90 includes a plurality of transistors TR1–TR7 and four diodes D1–D4. When the door 20 is opened, an output terminal OP2 of the MICOM 100 outputs a high level signal passing through a resistor R5, thereby driving a transistor TR5. A base and an emitter of a transistor TR3 are turned on due to a driving of the transistor TR5. The high level signal passes through a diode D3, drives the motor 31, passes through a diode D2, drives a transistor TR2, and is input to a collector of the transistor TR5 via a resistor R5. As a result, the current for driving the motor 31 flows from one terminal M− to the other terminal M+, thereby causing forward rotation of the motor.

Conversely, when the door 20 is closed, an output terminal OP3 of the MICOM 100 outputs a high level signal. The high level signal drives transistors TR7 and TR4, drives the motor 31 via a diode D4, passes through a diode D1, and is input to a collector of a transistor TR7 through an emitter and a base of the transistor TR1. As a result, since the current for driving the motor 31 flows from one terminal M+ to the other terminal M−, the motor reversely rotates, thereby closing the door 20.

The lamp driver 110 and the motor driver 90 receive an additional power-supply separated from the MICOM 100 through a power-supply unit (not shown) which rectifies alternating current (AC) power-supply at a predetermined voltage (e.g., 12V). Accordingly, the lamp driver 110 and the motor driver 90 reliably receive a voltage for both a door opening/closing and lamp driving, thereby enhancing reliability of operation.

Figures 6A, 6B:
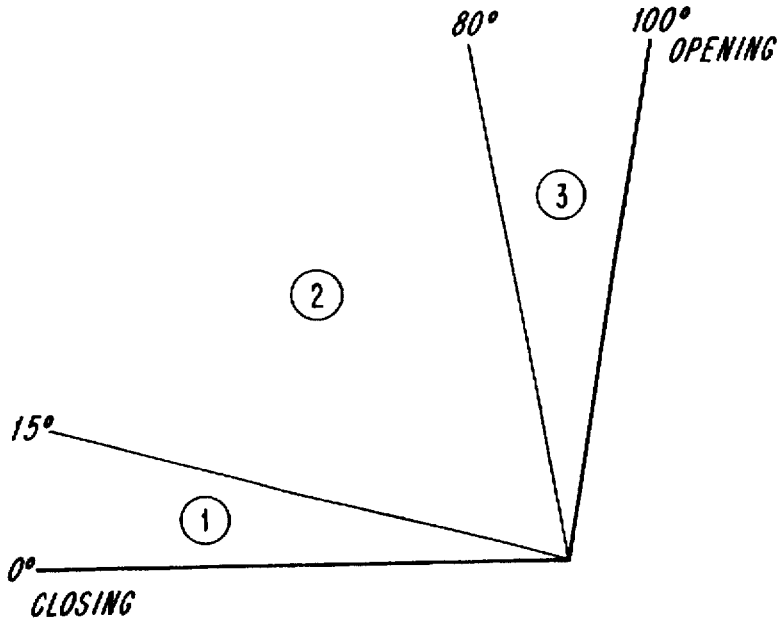
FIG. 6A schematically shows door opening/closing angles in response to the operating states of a door open sensor and a door closed sensor in the lamp driving control method according to the present invention.
FIG. 6B shows an ON/OFF state of a door opening sensor and a door closing sensor at each angle range shown in FIG. 6A.

FIG. 6A schematically shows door opening/closing angle regions as related to the operating states of a door open sensor and a door closed sensor in the lamp driving control method according to the present invention; and FIG. 6B shows an ON/OFF state for the door open sensor and the door closed sensor in each door angle region shown in FIG. 6A.

Referring to FIGS. 6A and 6B, when the door is opened below a predetermined angle, a contact of a reed switch 52 of the door open sensor 50 is off, and a high level signal is input to the MICOM 100. When the door 20 is opened beyond a predetermined angle, for example, when the door 20 is opened beyond 80°, a contact of the reed switch 52 indicates an ON state by virtue of its position relative to a magnet 51 positioned at the door 20, at which time a low level signal is input to an input terminal OP2 of the MICOM 100, so that a fully opened state of the door 20 is sensed.

Herein, a fully opened door state means that the door is sufficiently opened for the laundry to be put into the washing machine or removed therefrom. In the present invention, this angle ranges from 80° to 100°.

In the door closed sensor 60, when the door state is regarded as a fully closed state because the door 20 drops below a predetermined angle, a contact of a reed switch 62 indicates an ON state, and a low level signal is input to the MICOM 100. When the door is opened beyond a predetermined angle such as 15°, the contact of the reed switch 62 is off, a high level signal is input to the MICOM 100, so that the door 20 is not sensed as fully closed.

Figure 7:
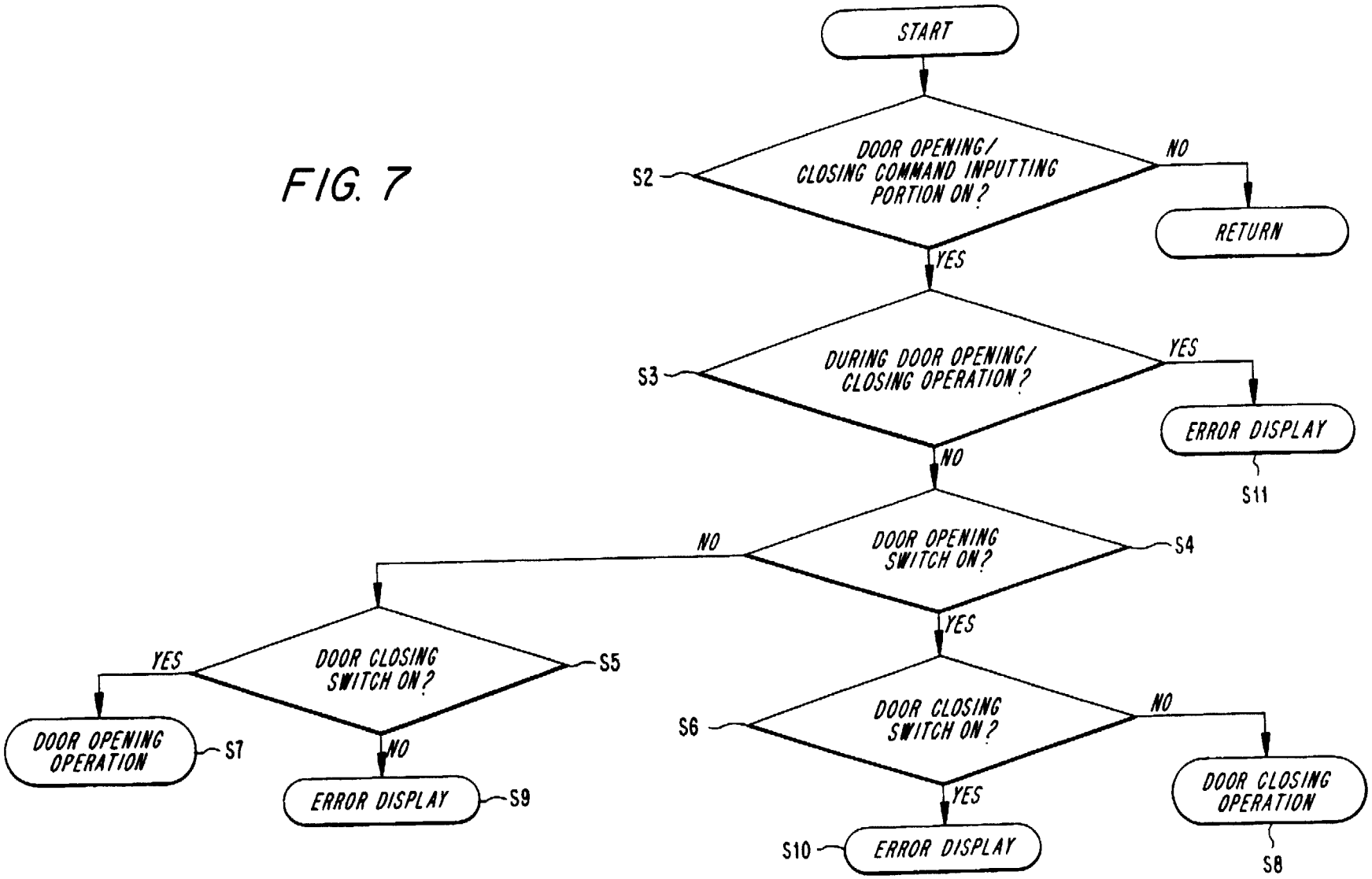
FIG. 7 is a flow chart showing a procedure for detecting a fully door opening/closing according to a principle of the present invention.

FIG. 7 is a flow chart showing a procedure for detecting a full door opening/closing according to a principle of the present invention.

As shown in FIG. 7, at step S2 it is determined whether the door open or closed sensor is in an ON state by virtue of an opening/closing command input. If the door opening or closing sensor is ON, the step S3 judges whether the door opening or closing operation is in progress. If both sensors are in operation, an error is displayed (step S11). If only one of the sensors is in operation, the process advances to step S4.

At step S4 it is determined whether the door open sensor is ON. If the door open sensor is ON, step S6 determines whether the door closed sensor is ON. If the door closed sensor is ON, and the door open sensor is ON, that means an operation error has occurred. Accordingly, an operation error state is displayed on the display (step S8).

At this time, the error state in step S10 means that either the door open sensor or the door closed sensor or both are malfunctioning. At this time, the lamp is not operated. When the door closed sensor is OFF in step S6, only the door open sensor is ON which indicates a door opened state, so that the door closing operation is performed (step S8).

On the other hand, when the door open sensor is not ON in step S4, step S5 checks whether the door closed sensor is ON. If the door closed sensor is ON it means a door closed state, and a door opening operation is performed (step S7).

If at step S5 it is determined that the door closed sensor is not ON, both the door open and closed sensors are OFF which means an operation error. At this time, the door is not located in an area that is sensed by the door open or closed sensors, that is, the door is ajar. In this case, the lamp is not operated.

Figure 8:
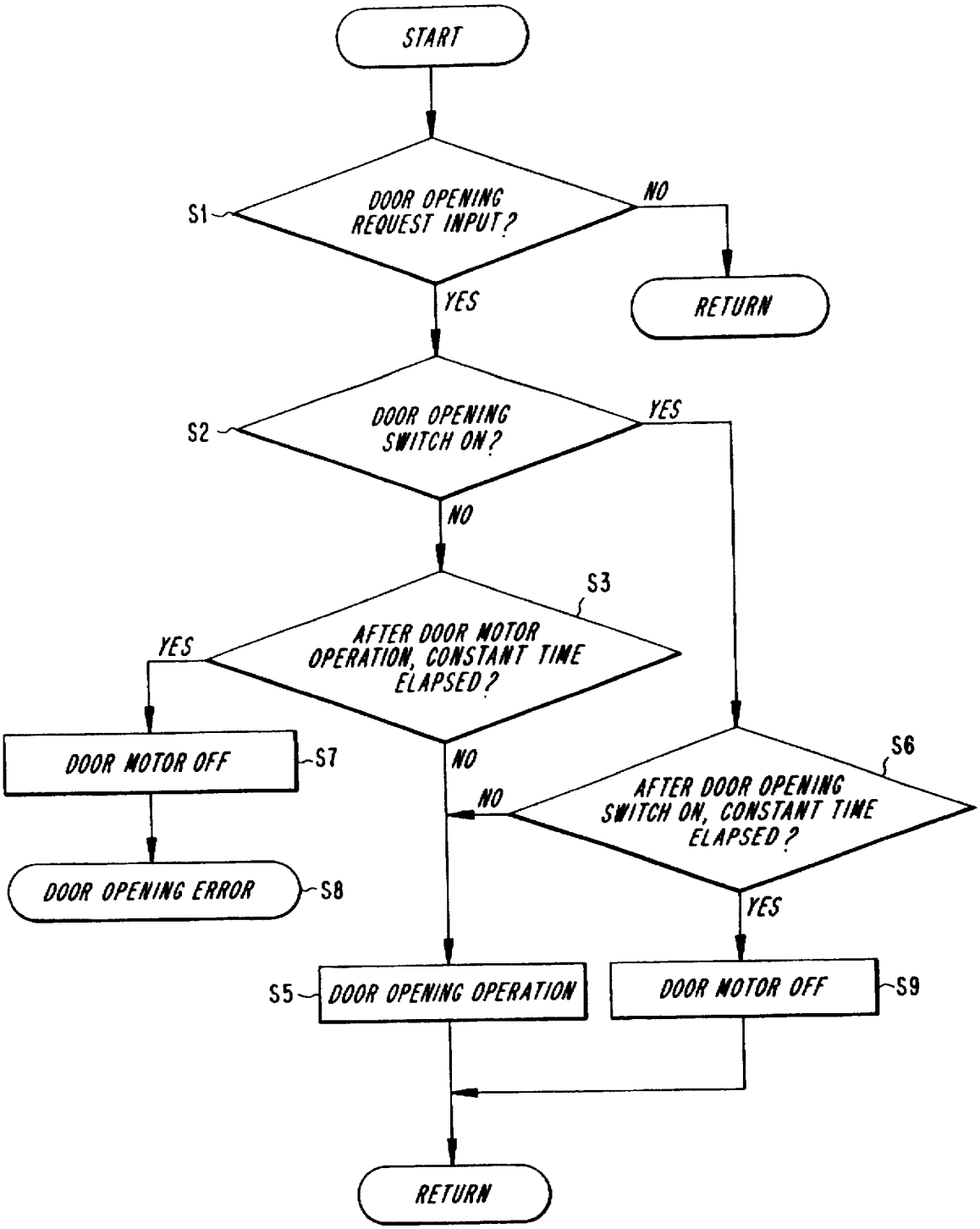
FIG. 8 is a flow chart wherein a door opening operation relates to a door motor operation.

FIG. 8 is a flow chart wherein a door opening operation relates to a door motor operation.

After a door open request is input (step SI), at step S2 it is determined whether the door open sensor is ON. If the door open sensor is ON, at step S6 it is determined whether a predetermined time elapses. If the predetermined time elapses, the door motor is turned OFF (step S9), and the operation step returns.

Otherwise, when the door open sensor is not ON at step S2 and a predetermined time elapses after operating the door motor (step S3), the MICOM 100 determines that the door opening request is not smoothly performed, therefore turns off the door motor (step S7), and displays a door opening error (step S8).

The door opening error state shown in FIGS. 7 and 8 can be indicated by using a display, or can be indicated as an error sound by using a buzzer.

Figure 5:
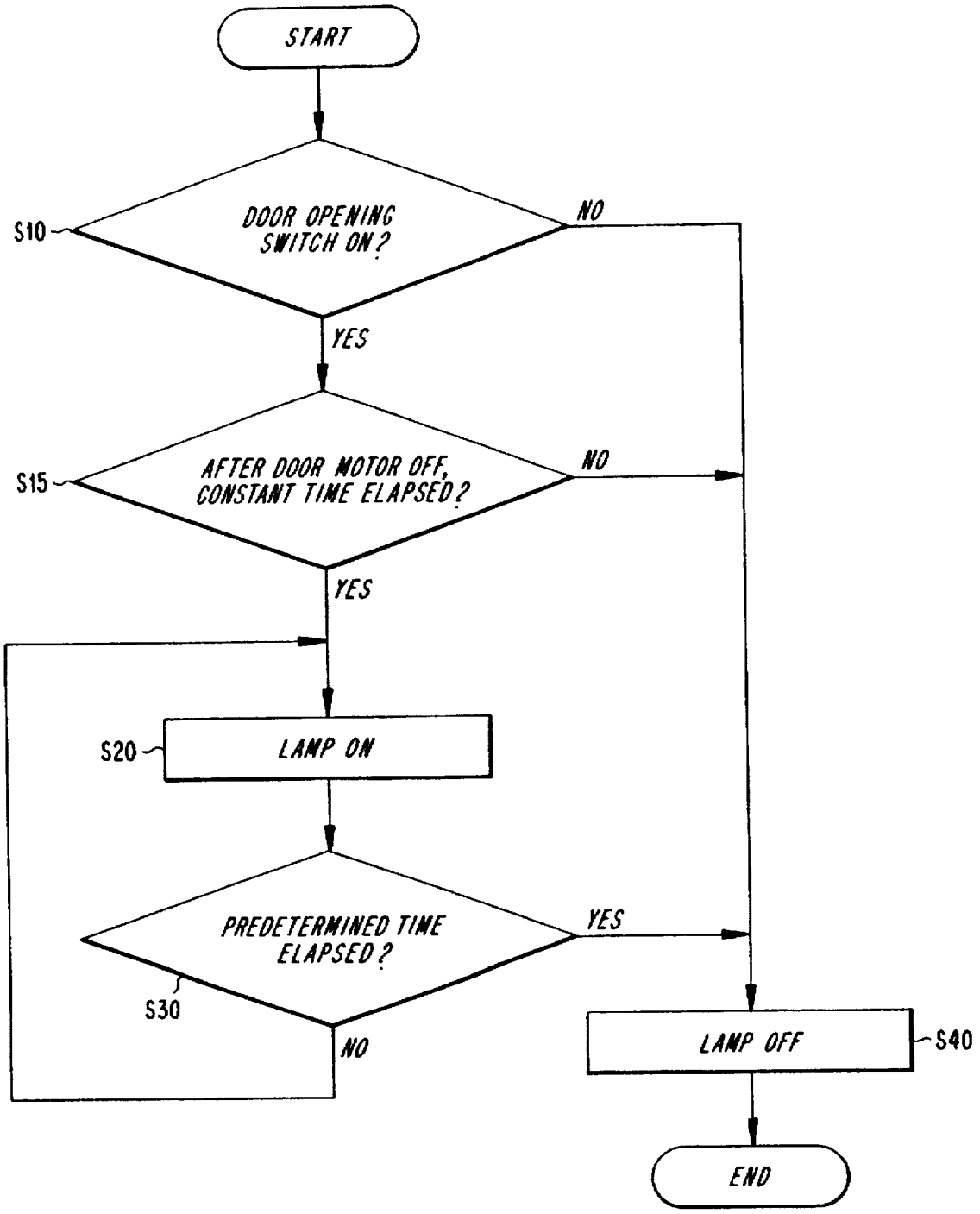
FIG. 5 is a flow chart of a lamp driving control method for a washing machine according to the present invention.

A lamp driving control method based on FIGS. 7 and 8 according to the present invention is shown in FIG. 5. Sensing that the door 20 is opened beyond a predetermined angle is performed by a reed switch 51 of the door open sensor. At step S10 it is determined whether the reed switch 51 is ON or OFF. As a result, if the switch 51 is ON, step S15 starts. If the switch 51 is not ON, step S40 starts, thereby turning off the lamp.

In step 15, when the door opening operation is achieved in a normal fashion and the switch 51 is ON (door angle: about 80°), a power supply for driving the door motor is cut off. However, the door motor normally continues to rotate by its torque and inertia as much as a predetermined angle, so that the door is opened beyond 80°. This state is regarded as fully opened, where the step S20 starts, and the lamp is turned on. At this point, the door motor state is off, as shown in step S9 in FIG. 8. That is, a normal door opening operation has been achieved.

If the predetermined time has not elapsed after the door motor is shut off in step S15, the MICOM determines that the door is not fully opened, and turns off the lamp at step S40.

At step S30 it is determined that a predetermined time has elapsed after turning on the lamp. If the predetermined time has not elapsed, the MICOM 100 returns to step S20, and turns on the lamp. If the predetermined time has elapsed, the MICOM 100 returns to step S40, and turns off the lamp.

The lamp driving control method according to the present invention will be more specifically described below.

When the door 20 is opened beyond a predetermined angle and is regarded as fully opened in steps 10 and 20, that is, when a high level signal is input to an input terminal IP1 of the MICOM 100 due to the door closing sensor 60 contact turning off, the contact of the door opening sensor 60 is ON and a low level signal is input to the other input terminal IP2 of the MICOM 100. In this case, the MICOM 100 determines that the door is fully opened, and turns on the lamp 80 by applying power to the lamp 80.

However, when a signal sensed by the door closed sensor 60 is at a high level in step S10, and a signal sensed by the door open sensor 50 is not at a low level, a power-supply is cut off in the step S40, so that the lamp 80 is turned off.

After the lamp 80 is turned on at step S20, step S40 starts when a predetermined time (e.g., three minutes) elapses in step S30, so that the lamp 80 is turned off.

As described above, according to a lamp driving control apparatus and a method therefor, the lamp is turned on only when the door is fully opened beyond the predetermined angle, and power-consumption waste caused by a frequent door opening operation can be prevented.

It will be apparent to those skilled in the art that various modifications and variations can be made in a lamp driving control apparatus for a washing machine and a control method therefor according to the present invention without departing from the spirit or scope of the invention. Thus, it is intended that the present invention cover modifications and variations of this invention provided they come within the scope of the appended claims and their equivalents.

What is claimed is:

1. A lamp driving control apparatus for use in a washing machine, which washing machine includes a main body, a door mounted to the main body, a door motor for opening and closing the door and a lamp that is turned on when the door is opened in order to illuminate an interior of the main body, the control apparatus comprising:

a door open sensor for sensing whether the door is opened by a predetermined angle corresponding to a fully opened door; and a controller for turning on the lamp when the door is opened beyond the predetermined angle corresponding to the fully opened door.

2. The lamp driving control apparatus as set forth in claim 1, wherein the door open sensor includes a reed switch.

3. A lamp driving control method for use in a washing machine, which washing machine includes a main body, a door mounted to the main body, a lamp for illuminating an interior of the main body, a door motor for opening and closing the door, and door open and closed sensors for sensing a door open state or a door closed state, the method comprising the steps of:

sensing whether the door is in a fully opened or a fully closed state for a first predetermined time period; and turning on the lamp for a second predetermined time period when a fully opened door state is sensed for more than the first predetermined time period.

4. The lamp driving control method as set forth in claim 3, wherein the step of sensing the fully opened or closed door state for the first predetermined time comprises the steps of:

determining whether a door open or door close command has been entered by a user;

determining a current door state according to a sensed result from the door open and closed sensors; and determining whether a fully opened door state or a fully closed door state is indicated.

5. The lamp driving control method as set forth in claim 4, further comprising the step of:

turning on or turning off the lamp according to the fully opened door state or the fully closed door state respectively.

6. The lamp driving control method as set forth in claim 3, wherein the door fully opened state ranges from 80° to 100 ° from a door fully closed state.

7. A lamp driving control method for a washing machine, which washing machine includes a main body, a door mounted to the main body, a lamp for illuminating an interior of the main body, a door motor for opening and closing the door, and door open and closed sensors for sensing either an open or a closed door state, the method comprising the steps of:

determining whether the door is opened beyond a predetermined angle corresponding to a fully opened door state;

turning on the lamp for a first predetermined time when the door is fully opened, or turning off the lamp when the door is not fully opened; and turning off the lamp after the first predetermined time elapses after turning on the lamp.

8. The lamp driving control method as set forth in claim 7, wherein the step of determining whether the door is opened beyond the predetermined angle corresponding to the fully opened door state comprises:

a first step in which the door open sensor is turned 'ON' by driving the door motor to sense whether the door is opened; and a second step in which sensing is delayed for a second predetermined time period after the door motor stops driving.

* * * * *